US006168334B1

(12) United States Patent
Fordham

(10) Patent No.: US 6,168,334 B1
(45) Date of Patent: Jan. 2, 2001

(54) DEVICE AND ASSEMBLY

(75) Inventor: John F. W. Fordham, Gerrards Cross (GB)

(73) Assignee: Geka Manufacturing Ltd., London (GB)

( * ) Notice: Under 35 U.S.C. 154(b), the term of this patent shall be extended for 0 days.

(21) Appl. No.: 09/149,578

(22) Filed: Sep. 8, 1998

(30) Foreign Application Priority Data

Sep. 8, 1997 (GB) ..... 9719046

(51) Int. Cl.[7] ..... A46B 11/00
(52) U.S. Cl. ..... 401/122; 401/121
(58) Field of Search ..... 401/122, 121, 401/118, 126; 132/218

(56) References Cited

U.S. PATENT DOCUMENTS

| | | | | |
|---|---|---|---|---|
| 3,084,374 | | 4/1963 | Ziegler . | |
| 3,549,266 | * | 12/1970 | Vasas | 132/218 |
| 3,554,657 | * | 1/1971 | Aston | 401/122 |
| 4,194,848 | | 3/1980 | Kingsford . | |
| 4,241,743 | | 12/1980 | Schnabel et al. . | |
| 4,761,088 | | 8/1988 | Zubek . | |
| 5,490,737 | | 2/1996 | Gueret . | |
| 5,599,125 | | 2/1997 | Vasas et al. . | |

FOREIGN PATENT DOCUMENTS

| | | | | |
|---|---|---|---|---|
| 37 04496 C1 | | 10/1987 | (DE) . | |
| 37 04 496 | * | 10/1987 | (DE) | 401/122 |
| 296 13996 U1 | | 11/1996 | (DE) . | |
| 0 627 182 A1 | | 12/1994 | (EP) . | |
| 1 276 859 | | 6/1969 | (GB) . | |
| 2 097 662 | | 11/1982 | (GB) . | |
| 2097662 | * | 11/1982 | (GB) | 401/122 |
| 2 158 703 | | 11/1985 | (GB) . | |
| 2 312 617 | | 11/1997 | (GB) . | |
| WO 95/26147 | | 10/1995 | (WO) . | |

* cited by examiner

*Primary Examiner*—David J. Walczak
(74) *Attorney, Agent, or Firm*—Ohlandt, Greeley, Ruggiero & Perle, L.L.P.

(57) ABSTRACT

A wiper unit for a cosmetics applicator is provided with resilient fingers at an obtuse angle to the axis of its orifice, and occupying at most 50% of the orifice area.

15 Claims, 1 Drawing Sheet

DEVICE AND ASSEMBLY

Figure 1:
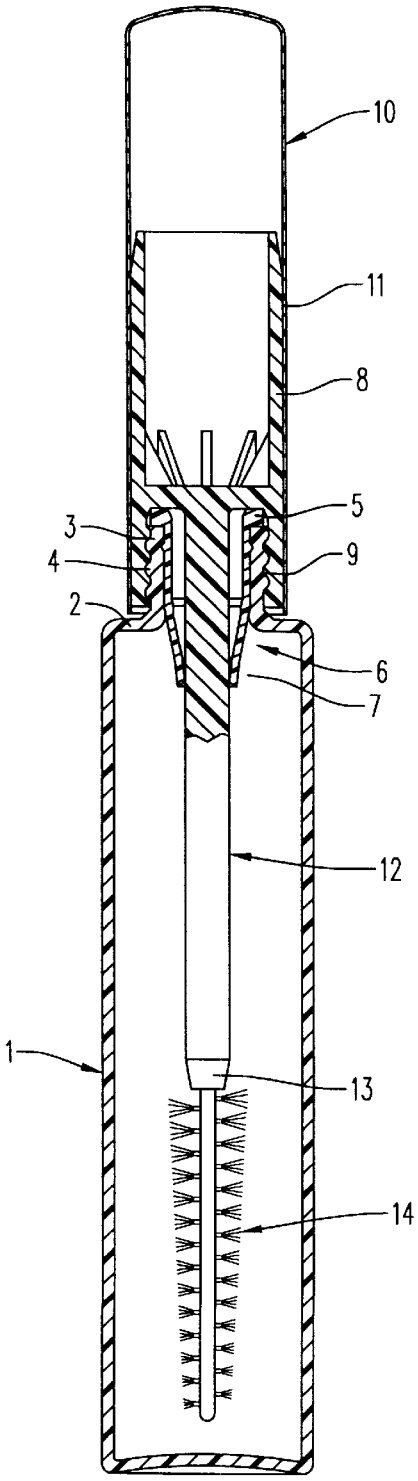

This invention relates to a material applicator assembly, more especially to an applicator assembly for a cosmetics material, for example, mascara, and to a device for use therein.

Such an assembly normally comprises a container for the cosmetic, a closure cap with a rod at the free end of which is an applicator, for example a brush, and located within the container a wiper having an orifice which, as the rod and applicator are withdrawn from the container, wipes clean the rod and removes excess material from the applicator, leaving a desired quantity of material on the applicator.

A conventional wiper is satisfactory to the extent that it removes excess material from the edge of the applicator and may control the quantity of material within it when, for example, as is frequently the case with a mascara applicator, the applicator is a brush in which the mascara lies on, between and even within the fibres of the bristles. Conventional wipers are, however, less satisfactory in that they allow to remain, or even form, a drop or thread of material at the free end of the applicator.

In International Application WO 95/26147 there is described, for use in such an assembly, a wiper device having, in addition to the conventional resilient portion with an orifice that is a close fit around the applicator rod, a plurality of resilient fingers extending inward from the material defining that orifice which close in on the free end of the applicator as it is drawn through the wiper and detach at least some of the material that is present on the free end of the wiper.

While the above-mentioned wiper device is effective, it does have some disadvantages. As will be appreciated, the relaxed diameter of the material defining the orifice is itself designed to be slightly less than the diameter of the rod, and the fingers extend inward from there. When the assembly is in its closed storage position, the material of the fingers is substantially deformed from its equilibrium configuration by the rod. Although in the referenced International Application it is proposed to alleviate this by providing the rod with an annular groove in the location contacted by the fingers, it has nonetheless been found that following prolonged storage the fingers do not close sufficiently onto the applicator as it is withdrawn through the wiper.

This tendency of the fingers to set in the deformed position (or, using other terminology, to lose their memory) is a significant disadvantage in that it restricts the shelf-life of the product and may inconvenience an infrequent user of a particular mascara unit.

The present invention provides a wiper device suitable for use in a cosmetics applicator assembly, which comprises an elongate hollow resilient body having a substantially circular orifice, and positioned around and extending directly from the periphery of the orifice a plurality of elongate resilient members, each having a free, distal, end portion, each member extending inward toward the axis of the orifice and away from the body, each member being at an angle within the range of from 900 to 1200 to the axis and tapering toward the distal end, the members being radially spaced apart at least at their distal ends, and occupying at most 50% of the area of the orifice as viewed axially.

It will be appreciated that the orientation of the members defined above is that adopted when the wiper device is in its relaxed or equilibrium configuration, i.e., in the absence of deformation by, for example, the rod of a cosmetics material applicator. When the wiper is in position about such a rod, the members will extend along the rod, bearing resiliently against it.

In operation, accordingly, as an applicator rod is withdrawn from a container in which a wiper according to the invention is fitted, with the end of the wiper carrying the members facing away from the container opening, the edge or face of the wiper orifice will remove viscous material from the rod, and control the quantity of material remaining on the applicator, the elongate members bearing resiliently against the rod as it passes by until, when the applicator begins to pass the members, they are drawn backward into the brush by the action of the fibres. As the free end of the applicator passes, the members spring out, removing at least part of the drop of material from the end of the applicator.

It will be appreciated that where the applicator is a brush the elongate members will recover toward their equilibrium configuration by intermingling with the brush to a greater or lesser extent as the brush passes them, the extent depending on the flexibility of the members and the nature of the brush, which advantageously is one having radially extending bristles.

The physical properties of the material of the members, and their mechanical properties resulting from the shape of the members, may be selected so that as the applicator passes the members their distal ends are drawn toward the body, intermingling with the bristles if the applicator is a brush. If as is typically the case the free end of the applicator is tapered, the free ends of the resilient members will tend to return toward their equilibrium configurations as the applicator end approaches, and will "flick" or snap back as this stage of withdrawal, assisting in removing the final drop from the applicator.

Advantageously, the wiper is provided with from three to five, preferably four, elongate members. The spacing between the members advantageously increases from their proximal to distal ends, i.e., the free end of each wiper will subtend a smaller angle viewed along the axis of the orifice than does the proximal end, and if desired the extremities of the proximal ends of the members may merge to be in contact. Advantageously, however, the proximal ends are spaced apart, and may occupy at most 50% of the circumferential length of the orifice. Advantageously, the distal ends of the members taper, i.e., are roughly triangular. The wider proximal portions provide an enhanced resistance to deformation set while the tapering distal end portions do not remove significant quantities of material from the length of the applicator as it is withdrawn, but are flexible so as to enhance removal from the free end of the applicator (which is normally tapered) any adherent blob of material as it is withdrawn past them.

Advantageously, when the wiper is viewed along the axis in its relaxed configuration, the elongate members occupy at most 50%, and preferably from 40 to 50%, most preferably about 45%, of the area of the wiper orifice. Also, advantageously, the distance between a pair of opposed distal ends is at most 25% of the diameter of the orifice, preferably at most 20%, and more preferably at most 10%. In principle, the distal ends of the members may be in contact but such a construction is not readily achieved by the presently preferred manufacturing process.

Referring again to the elongate members in their relaxed configuration, each advantageously comprises a proximal portion that tapers toward the distal end either as seen along the axis of the aperture, or as seen transverse to the axis, or, preferably, as seen in both such directions. Advantageously, the proximal portion of the member itself is of rectangular cross-section. The distal portion of each member advantageously tapers toward the distal end as seen along the axis of the aperture, or as seen transverse to the axis or, preferably, as seen in both such directions. Advantageously, the distal portion of the member is of rectangular cross-section, except for the distal end itself, which is advantageously triangular, as will be described in more detail with reference to the drawings. The member advantageously tapers regularly from one end to the other. Each member is advantageously generally straight in its undeformed configuration.

The device is advantageously formed of a thermoplastic, elastomeric, or thermoplastic elastomeric material, for example, a synthetic or natural rubber, a polyurethane, an olefinic homo- or co-polymer, e.g., polyethylene, especially low density polyethylene, or an ethylene-unsaturated ester copolymer, for example an ethylene-vinyl acetate copolymer. The device may be formed of a laminate or blend of two or more such materials.

The invention also provides a material applicator assembly comprising a container for a viscous material, a closure member, an applicator attached to the closure member by a rod, and a wiper device according to the invention located within the container, advantageously positioned about the rod.

The invention further provides the use of a wiper device according to the invention to remove drops from the free end of a material applicator as it is withdrawn through the wiper device.

Figure 2:
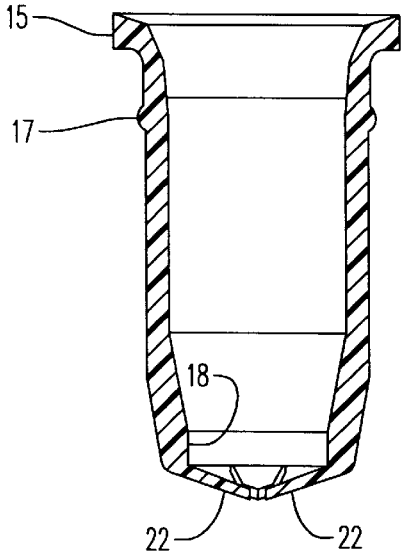
Figure 3:
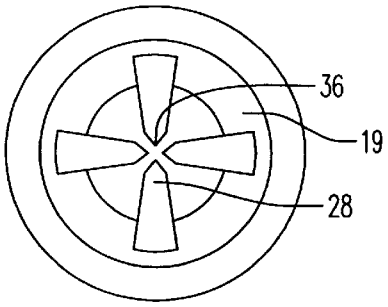
Figure 4:
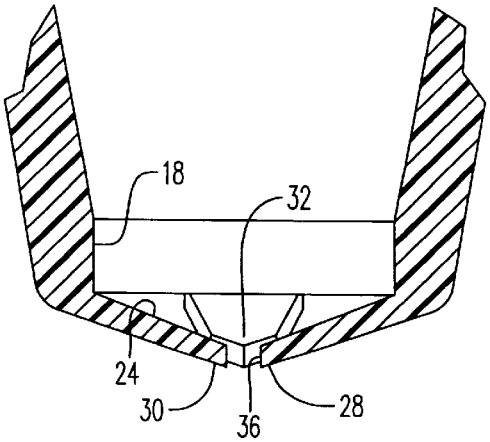

One form of wiper device and assembly constructed in accordance with the invention will now be described in greater detail, by way of example only, with reference to the accompanying drawings in which:

FIG. 1 shows a longitudinal section through an applicator assembly constructed in accordance with the invention, FIG. 2 shows a longitudinal section through a wiper device constructed in accordance with the invention, FIG. 3 shows a plan view of the device of FIG. 2, FIG. 4 shows a part of FIG. 2 enlarged to show details of the resilient members.

Referring to FIG. 1, an applicator assembly, in particular a mascara unit, is shown. The unit comprises a thermoplastics container indicated generally by the reference numeral 1 having a neck portion 3 with an external thread 4 joined to the body of the container by a shoulder 2.

A cap 8 provided with an internal thread 9 is fitted onto the external thread 4 of the neck 3, an outside cover 10 being held in position over the cap 8 by a heat-setting adhesive layer 11, or simply by a force fit. Extending from the cap 8 into the interior of the container 1 is a rod 12, to the lower end 13 of which is attached an applicator brush 14. A wiper device indicated generally by the reference numeral 6 having a rim 15 (see FIG. 2) is located in the neck 3, the rim 15 providing a seal 5 between the container 1 and the cap 8.

Referring now more especially to FIGS. 2, 3 and 4, the wiper device 6 is shown in more detail. As indicated above, it has at its upper end a rim 15 which, in addition to providing a seal, forms a stop to locate the device 6 in the neck 3, and a bead 17 on the outside wall of the body just below the rim 15 serves to engage with a corresponding recess in the inside wall of the neck 3 and assist in sealing and ensuring a secure fit. The external and internal surfaces of the wall of the body of the device are angled inwards so that the device tapers toward its lower end wall 19, the internal wall surface terminating in a wiping surface 18 occupying 360° of arc. Extending from the lower end wall 19 are four spaced apart wiping fingers 22 extending toward the axis. As may be seen most clearly from FIG. 3, each finger 22 tapers toward the free, distal, end 28. The fingers 22 are of rectangular cross-section, all faces of the rectangle becoming smaller with approach to the free, distal, end 28. The angle between the inner face 24 of each finger 22 and the wiping surface 18 (which is parallel to the axis of the device 6) is about 110°. The outer face 30 and the inner face 32 of the terminal section of the distal end 28 are triangular, the faces 30 and 32 being offset to provide an edge 36 parallel to and slightly away from the axis of the device 6. The four fingers occupy about 45% of the area of the orifice defined by the wiping surface, when viewed axially, as seen in FIG. 3.

Typically, the diameter of a mascara applicator rod is within the range of 2.5 to 4.5 mm. For a 4.3 mm rod, the diameter of the wiping surface may be about 4.2 mm, the length of the fingers measured along the inner face being 2.0 to 2.2 mm, the edges 36 of diametrically opposed fingers being about 0.25 mm apart. As examples of materials from which the wiper may be constructed, there may be mentioned a low density polyethylene/thermoplastic elastomer blend, for example in proportions of about 1:2 by weight, and wholly elastomeric materials, for example a nitrile rubber, for example an elastomeric material with a Shore hardness in the range of 70 to 80.

What is claimed is:

1. A wiper device suitable for use in a cosmetics applicator assembly, which comprises an elongate hollow resilient body having a substantially circular orifice, and positioned around and extending directly from the periphery of the orifice a plurality of elongate resilient members, each having a free, distal, end portion, each member extending inward toward the axis of the orifice and away from the body, each member being at an angle within the range of from 90% to 120% to the axis and, when viewed axially, tapering toward the distal end, the members being radially spaced apart at least at their distal ends, and occupying at most 50% of the area of the orifice as viewed axially.

2. A device as claimed in claim 1, having from three to five members.

3. A device as claimed in claim 2, having four members.

4. A device as claimed in claim 3, wherein the distance between a pair of opposed distal ends is at most 25% of the diameter of the orifice.

5. A device as claimed in claim 4, wherein the distance is at most 10% of the diameter of the orifice.

6. A device as claimed in claim 1, wherein the members have proximal ends spaced apart around the orifice periphery.

7. A device as claimed in claim 1, wherein the members occupy from 40% to 50% of the area of the orifice as viewed along the axis.

8. A device as claimed in claim 1, wherein the distal extremity of each member forms an edge substantially parallel to the axis.

9. A device as claimed in claim 1, formed of a material selected from the group consisting of a thermoplastic, elastomeric and thermoplastic elastomeric materials, blends of at least two such materials, and laminates of at least two such materials.

10. A device as claimed in claim 9, wherein the material is selected from the group consisting of a low density polyethylene and an ethylene-vinyl acetate copolymer.

11. A material applicator assembly comprising a container for a viscous material, a closure member, an applicator attached to the closure member by a rod, and a wiper device as claimed in claim 1, located within the container.

12. A cosmetics applicator assembly comprising a container for a viscous material, a closure member, an applicator brush having radially extending bristles, the brush being attached to the closure member by a rod, and a wiper device, which device comprise s an elongate hollow resilient body having a substantially circular orifice, and spaced apart around the periphery of the orifice from three to five elongate resilient members, each having a free, distal, end portion, each member extending inward toward the common axis of the orifice and the rod and away from the body, each member being at an angle within the range of from 90° to 120° to the axis and, when viewed axially, tapering toward the distal end, the members being in contact with the rod at their distal ends, and occupying at most 50% of the area of the orifice as viewed axially.

13. The assembly of claim 12, wherein there are four elongate resilient members, the members are at an angle of at least about 110° to the axis and the distance between a pair of their opposed distal ends is at most 10% of the diameter of the orifice.

14. The method of removing drops of material from a free end of an applicator brush which comprises withdrawing the brush through the wiper device of claim 1 in a direction such that each part of the brush passes the free, distal, ends of the members before passing through the orifice.

15. The method of removing material from a free end of an applicator brush which comprises withdrawing the brush through the wiper device of claim 1, the brush passing the free, distal, ends of the members and drawing them backward into the brush so that on passage of the free end of the brush the members spring out removing material from the free end of the brush.

* * * * *